US006466116B1

(12) United States Patent
Ho et al.

(10) Patent No.: US 6,466,116 B1
(45) Date of Patent: Oct. 15, 2002

(54) STARTER MOTOR

(75) Inventors: Shine Ho, Harlingen, TX (US); William James Oswald, Brownsville, TX (US); Alberto Luis, Pharr, TX (US); Maximo De Leon, San Benito, TX (US); Robert Thrasher, Brownsville, TX (US)

(73) Assignee: Johnson Electric S.A., La Chaux-de-Ford (CH)

( * ) Notice: Subject to any disclaimer, the term of this patent is extended or adjusted under 35 U.S.C. 154(b) by 54 days.

(21) Appl. No.: 09/676,509

(22) Filed: Oct. 2, 2000

(51) Int. Cl.[7] ..... H01H 67/02
(52) U.S. Cl. ..... 335/126; 335/220
(58) Field of Search ..... 74/6–8; 335/126, 335/131, 220–229

(56) References Cited

U.S. PATENT DOCUMENTS 2,923,162 A 2/1960 Rainey
4,308,462 A 12/1981 McMillen
4,502,429 A 3/1985 Ebihara
4,899,604 A 2/1990 Morishita et al.
4,945,777 A 8/1990 Isozumi
5,044,212 A 9/1991 Isozumi et al.
5,099,703 A 3/1992 Isozumi
5,118,960 A 6/1992 Sasamoto et al.
5,596,902 A 1/1997 McMillen
5,760,487 A 6/1998 Kimura et al.
6,109,122 A * 8/2000 Bori et al. ..... 74/7

* cited by examiner

*Primary Examiner*—Lincoln Donovan
(74) *Attorney, Agent, or Firm*—Birch, Stewart, Kolasch & Birch, LLP

(57) ABSTRACT

A starter motor for an internal combustion engine has an inertia type pinion mechanism and an axial solenoid 34 which is arranged to prevent pump out of the pinion 48 during start up of the engine.

4 Claims, 3 Drawing Sheets

STARTER MOTOR

BACKGROUND OF THE INVENTION

The present invention relates to an inertia drive type starter motor for an internal combustion engine.

Inertia drive type starter motors rely on inertia of the pinion or clutch mechanism to move the pinion from a rest position to an engaged position against a spring force when the motor is switched on. Such motor drives have been used successfully but do suffer from false starts whereby the pinion is disengaged prematurely by sudden rotation of the engine being started which occurs not only when the motor starts but also when the engine misfires or fires but does not start. These false starts disengage the starter motor pinion requiring the starting sequence to be re-initiated. They can also suffer from bounce out or pump out which is a condition where the pinion oscillates along the shaft while engaging the engine ring gear and is a condition that can result in complete disengagement.

Thus a positive engagement mechanism for an inertia drive is desirable. Two such type drives are shown in U.S. Pat. No. 2,923,162 and U.S. Pat. No. 4,502,429. U.S. Pat. No. 4,502,429 shows a device which is very complex while U.S. Pat. No. 2,923,162 shows a device wherein the inertia drive is not assisted by the holding mechanism.

SUMMARY OF THE INVENTION

According to one aspect thereof, the present invention provides an electric starter for an internal combustion engine comprising: an electric motor having a housing and a rotatable armature shaft extending therethrough, the shaft having a helical spline portion; a pinion gear mounted for selectively engaging a ring gear of the engine; a clutch assembly for transmitting torque between the shaft and the pinion gear, the clutch assembly having a driving part and a driven part, the driving part having an internal helical spline portion engaging the helical spline portion of the shaft whereby relative rotary movement between the shaft and the driving part creates axial movement of the clutch assembly along the shaft, and the pinion gear being fixed for rotation with the driven part; and a solenoid for holding the pinion gear in engagement with the ring gear wherein the solenoid has a toroidal coil and a tubular plunger located about the shaft between the motor housing and clutch assembly, the tubular plunger having a radially extending flange at a first end which is arranged to be attracted to the radial housing wall toward the coil.

According to a second aspect, the present invention provides a solenoid comprising a housing; a cap fitted to the housing and defining an internal void, the housing and the cap each having a through hole defining therebetween a through passage having an axis; a toroidal coil fitted to the housing about the through passage; a bearing fitted to the through hole in the housing and having a through hole aligned coaxially with the through passage; and a plunger having a tubular body extending axially along the through passage and slidably retained in the through hole of the bearing, the plunger having a radially extending flange at a first end of the tubular body.

BRIEF DESCRIPTION OF THE DRAWINGS

A preferred embodiment will now be described by way of example only with reference to the accompanying drawings, in which.

DETAILED DESCRIPTION OF THE PREFERRED EMBODIMENT

Figure 1:
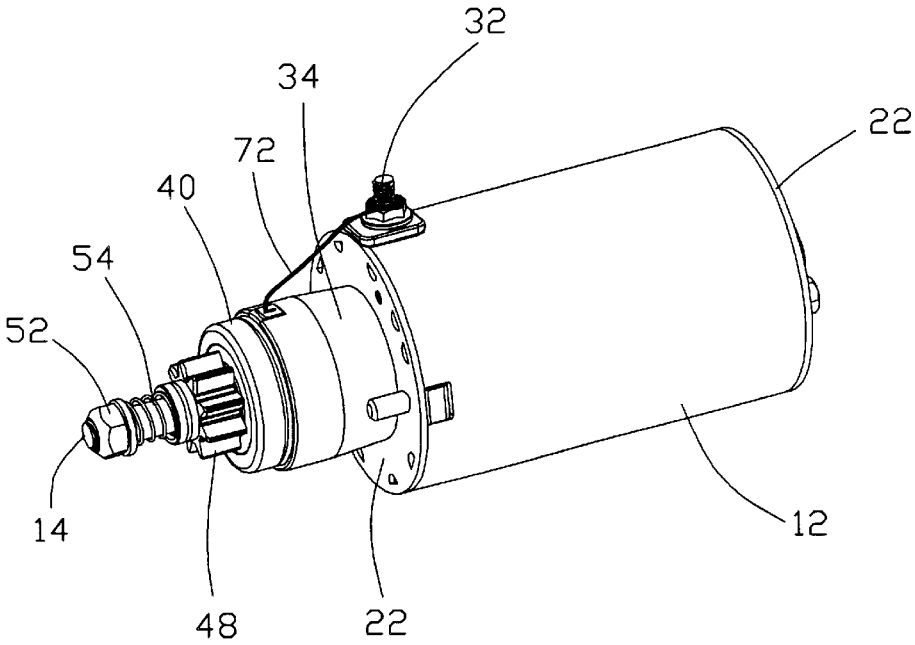
FIG. 1 depicts a starter motor according to a preferred embodiment of the present invention.

FIG. 1 shows a starter for an internal combustion engine. The starter comprises an electric motor 12 having a driving shaft 14, and a pinion mechanism. The pinion mechanism has a solenoid 34 that is mounted on an end plate 22 of the motor and a pinion 48 that is movable along the shaft 14.

Figure 2:
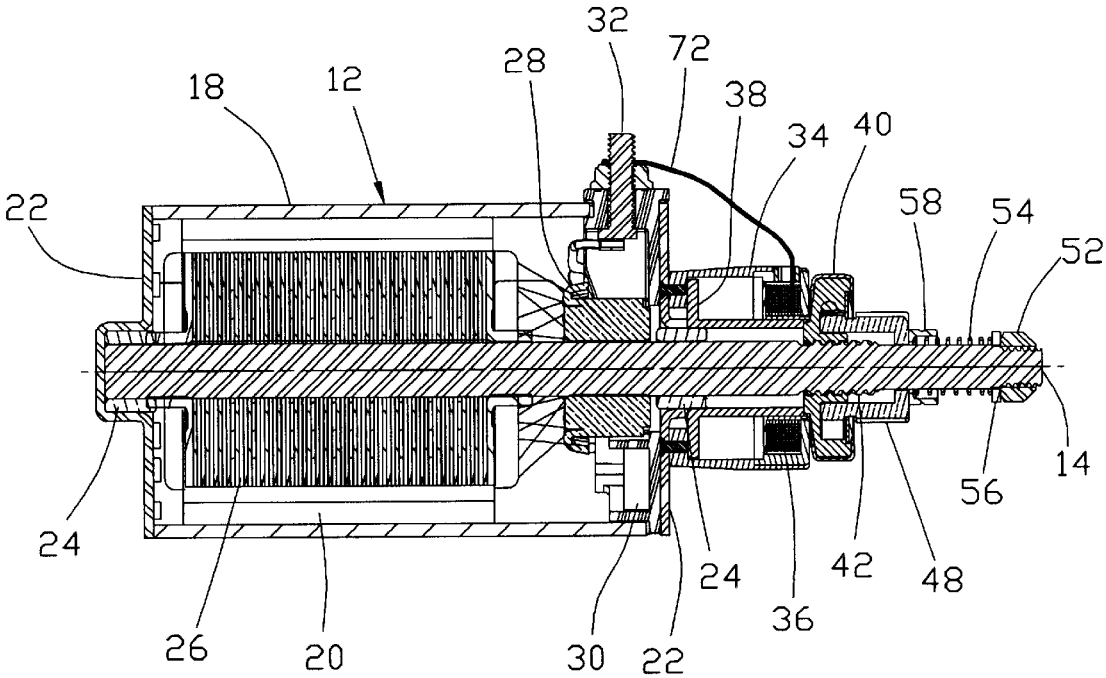
FIG. 2 is a sectional view of the motor of FIG. 1.

FIG. 2 is a longitudinal sectional view of the starter of FIG. 1. The motor 12 is of the DC permanent magnet type. The motor 12 has a housing 18 supporting permanent magnets 20. End plates 22 support bearings 24 in which the motor shaft 14 is journaled. The shaft supports a wound armature 26 and a commutator 28 fed by four conducting brushes 30. Two brushes are connected to the single motor terminal 32 and the other two are connected to the housing 18 which acts as a ground terminal.

Figure 3:
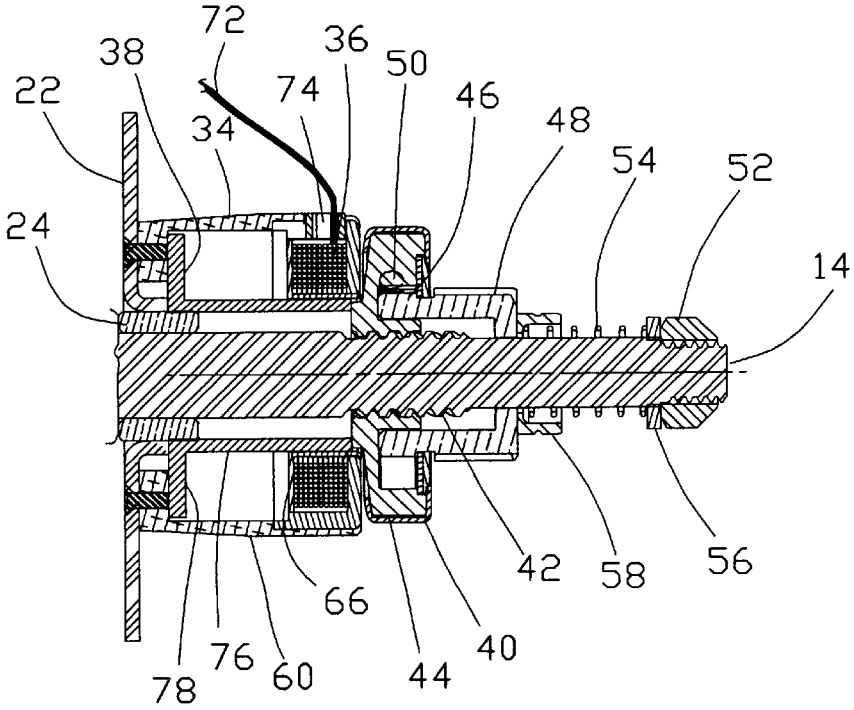
FIG. 3 is an enlarged sectional view of a drive mechanism of FIG. 2.
Figure 4:
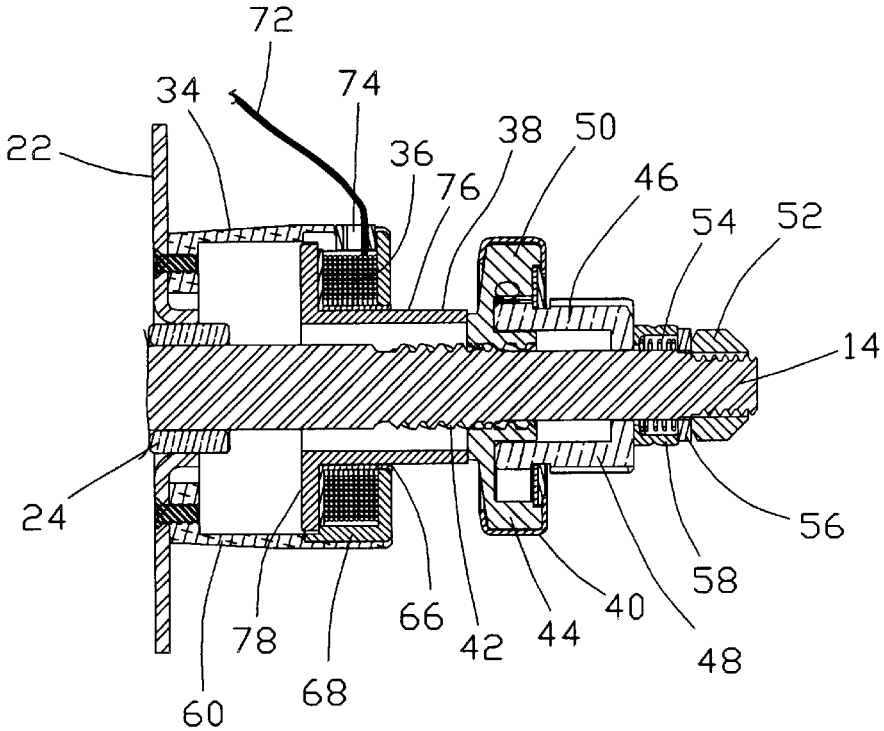
FIG. 4 is a view similar to FIG. 3 with the drive mechanism in an alternate engaged position.

On the output end of the shaft 14, outside the motor housing, is the pinion mechanism which is more clearly shown in FIGS. 3 and 4. The pinion mechanism comprises the pinion 48, an overrunning clutch 40 and the solenoid 34. The pinion 48 is moveable along the shaft 14 between a disengaged position as shown in FIG. 3 and an engaged position as shown in FIG. 4. In the engaged position, the pinion engages the teeth of a ring gear for starting an internal combustion engine (not shown).

Disposed between the pinion 48 and the solenoid 34 is an overrunning clutch, ORC 40, which is fitted to a helical spline 42 on the shaft 14. The ORC has a driving part 44 which engages the spline 42 and a driven part 46 which is integral with the pinion 48. The driving part and the driven part are connected together by a one way clutch mechanism 50 which allows the driven part 46 to turn with respect to the driving part 44 in one direction only.

Figure 5:
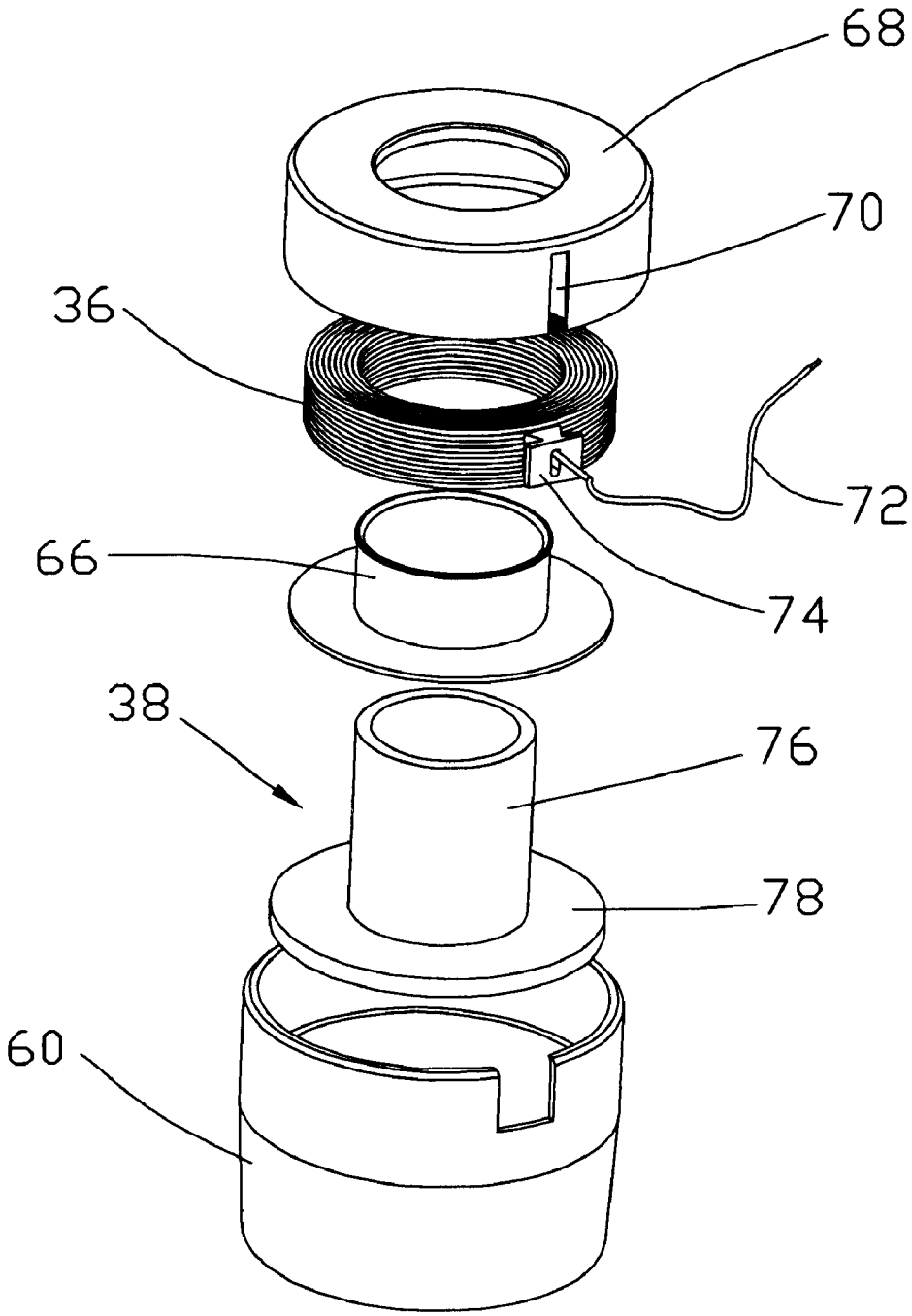
FIG. 5 is an exploded view of a solenoid forming a part of the drive mechanism.

The solenoid 34 is shown in exploded form in FIG. 5. The solenoid 34 has a cap 60, a plunger 38, a coil 36, a bearing 66 and a housing 68. The housing 68 accommodates the coil 36 and has a slot 70 for a lead wire 72 of the coil. Lead wire 72 is directly connected to the motor terminal (32, FIG. 2) so that the solenoid is energized with the motor. A rubber grommet 74 guides the lead wire 72 through the slot 70 and also seals the slot 72 against water and dust ingress. The other end of the coil (not shown) is soldered directly to the solenoid housing. The coil 36 is located about the bearing 66 and may be pressed onto the bearing 66 for support. One end of the bearing 66 is fitted to an axial hole passing through the solenoid housing 68. The other end of the bearing 66 has a flange for supporting the coil 36 against axial movement. The plunger 38 has an axially extending tube portion 76 which slides in the bearing 66 and locates about the shaft 14. A flange portion 78 extends radially from one end of the tube portion 76. The cap 60 covers the space about the plunger 38 between the housing 68 and the end plate 22 of the motor. The cap is crimped over the housing to seal the solenoid. The solenoid is fixed to the motor by two screws passing through motor end plate 22 and screwed into the cover 60.

When the solenoid is actuated, the magnetic field attracts the flange portion 78 to the radial wall of housing 68 toward coil 36. in the disengaged position, the force on the plunger may not be very strong but in the engage position, the flange 78 is adjacent the coil 36 and is held very strongly which is where the strength is needed. The plunger butts against the driving part 44 of the ORC allowing the ORC to rotate about the shaft with respect to the plunger. Alternatively, the plunger could be coupled or fixed to the ORC so that the plunger does rotate with the ORC, if desired.

Returning to FIGS. 3 and 4, a nut 52 is threaded onto the end of the shaft 14. An anti-drift spring 54 extends between the pinion 48 and the nut 52 to bias the pinion 48 into the disengaged position. A washer 56 is provided between the spring 54 and the nut 52 to provide a seat for the spring 54. At the other end of the spring, a sleeve or spacer 58 forms a seat and retainer for the spring 54 allowing the pinion 48 to rotate about the shaft 14 while compressing the spring 54 axially without significant torsional stress which may otherwise cause the spring 54 to bind on the shaft 14 or to become unwound affecting its spring properties.

When the motor 12 is turned on, the shaft 14 starts to rotate. Due to the inertia of the ORC 40, it does not rotate initially as fast as the shaft 14 and is thus moved axially to the right by the helical splines 42 as the shaft 14 turns relative to the ORC 40, against the urgings of the anti-drift spring 54. At the end of travel, the ORC 40 has moved towards the end of the shaft 14 to the engaged position, as shown in FIG. 4, where the pinion 48 is, in use, engaged with teeth of a ring gear fitted to a flywheel of the engine being started (not shown). The anti-drift spring 54 is now compressed. As the motor is switched on, power is also supplied to the solenoid 34, causing the plunger 38 to move to the right, axially with respect to the shaft, pressing against the ORC 40, helping the inertia movement and resisting pump out or disengagement of the pinion 48 from the ring gear, thereby providing positive retention of the pinion 48 in the engaged position until the power to the starter is switched off.

Once the power is switched off, the solenoid 34 releases the plunger 38 allowing the ORC 40 to return to the disengaged position. Assuming that the engine has started at this time, then the pinion 48 which is engaged with the ring gear will be rotating faster than the motor shaft because of the ORC 40. The ORC can now move axially under the influence of the anti-drift spring 54 by rotating about the shaft 14 on the helical splines 42.

If the engine has not started, once the starter motor has stopped rotating, the pinion 48 will slide freely out of engagement with the ring gear under the influence of the anti-drift spring 54. Thus the ORC 40 and pinion 48 return to the disengaged position, ready to try again.

While only the preferred embodiment has been described, various modifications will be apparent to persons skilled in the art and it is intended that all such modifications and variations form part of the invention as defined by the appended claims.

What is claimed is:

1. A solenoid, comprising:

a solenoid housing, said solenoid housing being hollow and having one open end;

a housing cap connected to said open end of said solenoid housing so as to form a hollow container;

said housing cap having a hole formed therein, and said solenoid housing having a hole formed therein so that both of said holes are formed along an axis of said solenoid housing;

a toroidal coil mounted inside said solenoid housing and having an axis aligned with said axis of said solenoid housing;

a bearing mounted in said solenoid housing and having a hole aligned with said axis in said solenoid housing; and a plunger having an axially extending cylindrical body with an axis in line with said axis of said solenoid housing and slidably retained within said hole of said bearing, said plunger having a radially extending flange at one end of said cylindrical body, wherein the plunger is contained within said solenoid housing.

2. The solenoid of claim 1, wherein the toroidal coil is located about the bearing.

3. The solenoid of claim 2 wherein the bearing has a radially extending flange at one end thereof for supporting the toroidal coil against axial movement.

4. The solenoid of claim 1, wherein the throw distance of the plunger is at least half the axial length of the solenoid.

* * * * *